US006095804A

United States Patent [19]

Ballabene

[11] Patent Number: 6,095,804

[45] Date of Patent: Aug. 1, 2000

[54] WALKING-BEAM FURNACE

[75] Inventor: Corrado Ballabene, Erkrath, Germany

[73] Assignee: Techint Compagnia Tecnica Internazionale S.p.A., Milan, Italy

[21] Appl. No.: 09/041,267

[22] Filed: Mar. 12, 1998

[30] Foreign Application Priority Data

Mar. 15, 1997 [DD] German Dem. Rep. ..... 197 10 870

[51] Int. Cl.[7] ..... F27B 9/00

[52] U.S. Cl. ..... 432/121; 432/127

[58] Field of Search ..... 432/127, 121, 432/122, 124, 234; 198/867.11, 867.13, 774.1, 776, 775; 414/750

[56] References Cited

U.S. PATENT DOCUMENTS

| | | | |
|---|---|---|---|
| 2,983,498 | 5/1961 | MacGregor | 198/775 |
| 4,025,298 | 5/1977 | Tokitsu | 432/122 |
| 4,203,514 | 5/1980 | Hirai | 414/750 |
| 4,391,587 | 7/1983 | Murakami et al. | 432/122 |
| 5,136,610 | 8/1992 | Heuss | 432/121 |
| 5,334,014 | 8/1994 | Orbeck et al. | 432/124 |

FOREIGN PATENT DOCUMENTS

| | | |
|---|---|---|
| 39 39 582 | 8/1990 | Germany . |
| 43 43 675 | 6/1995 | Germany . |

*Primary Examiner*—Denise L. Ferensic
*Assistant Examiner*—Jiping Lu
*Attorney, Agent, or Firm*—Merchant & Gould P.C.

[57] ABSTRACT

A walking beam furnace has in its interior fixed beams and walking beams for holding and transporting material to be annealed. These beams are provided with different support members for the material to be annealed, of which support members one serves for transporting flat material and the other for transporting round material. The different support members are arranged on the fixed and walking beams one after another in an alternating sequence.

16 Claims, 4 Drawing Sheets

WALKING-BEAM FURNACE

BACKGROUND OF THE INVENTION

For uniform heating of objects to be annealed, which may have either a rectangular or a rounded cross-section, walking beam furnaces are used, since these ensure transportation of the objects with less damage than, for example, pusher-type furnaces, through which the objects are pushed.

To ensure maintenance of the shape and load-bearing capacity of the walking and fixed beams even at high furnace temperatures, they generally consist of pipes having a cooling medium flowing through them.

German Offenlegungsschrift 39 39 582 discloses a walking beam furnace in which the walking and fixed beams through which the cooling medium flows are provided with support members for the objects to be annealed, wherein locking elements received by the support members can easily be welded to the beams owing to their ready accessibility. In one embodiment the supporting surface is depressed towards the middle to form a trough. This provides fences in the depressed region as a means of fixing the position of objects to be heated, such as rounded material, which do not have flat bearing surfaces.

German Offenlegungsschrift 43 43 675 describes a walking beam furnace in which the cooled walking beams and/or fixed beams are fitted with short fastening members for support members which run obliquely to the direction of transport and have flat supporting surfaces for the objects to be annealed. These support members can be fixed at the same angle by removable pins fitting in bores at their ends or in eyes.

A substantial disadvantage of the walking beam furnaces described above is that their supporting surfaces are only designed for rounded or for flat material.

SUMMARY OF THE INVENTION

With this as starting point, the object of the invention is to provide a walking beam furnace for heating both rounded and flat material.

This object is achieved by means of a walking beam furnace having different support members for round and for flat material fitted on its walking beams and its fixed beams.

The support members for flat objects, viewed in the feeding direction, have a middle portion which is wider and has a flat upper surface and a narrower downwardly sloping portion falling away both in front of and behind the middle portion in the feeding direction. The rounded object support members are trough-shaped, and have a narrow horizontal face, preferably in the middle, and two sloping portions rising up to the right and left thereof. The width of the rounded object support members, viewed in the feeding direction, can correspond to the width of the downwardly sloping portions of the flat object support members. The slopes of the rounded object support members and of the flat object support members are adapted to one another so as to result in the support members, when viewed from the side, having a wave-like upper surface in which recessed troughs alternate with raised flat faces. The troughs serve to secure the rounded objects against displacement from their transportation position. On the other hand flat objects to be annealed, such as slabs, can lie above the troughs on the projecting flat faces.

The slopes of the support members, when viewed in the direction of transport, also have faces which slope downwardly to the right and/or left. In the case of the support members for rounded objects these sloping faces are offset from one another, but in the case of the flat object support members each slope is bevelled both to the right and the left. The downwardly sloping faces reduce the accumulation of scale on the support members.

On their upper surface the walking beams and the fixed beams may have a lengthwise extending rib around which the U-shaped foot of the support member fits. The flat object support members, which have a bore in their side, are fixed to the longitudinal rib by means of pins. The rounded object support members are pushed on to the longitudinal rib and are each form-locked in place between two flat object support members and thus prevented from coming loose. This makes easy exchange of the rounded object support members possible.

BRIEF DESCRIPTION OF THE DRAWINGS

The invention will now be described in more detail, by way of example, with reference to an embodiment shown in the drawings, in which.

DETAILED DESCRIPTION OF PREFERRED ENVIRONMENT

Figure 1:
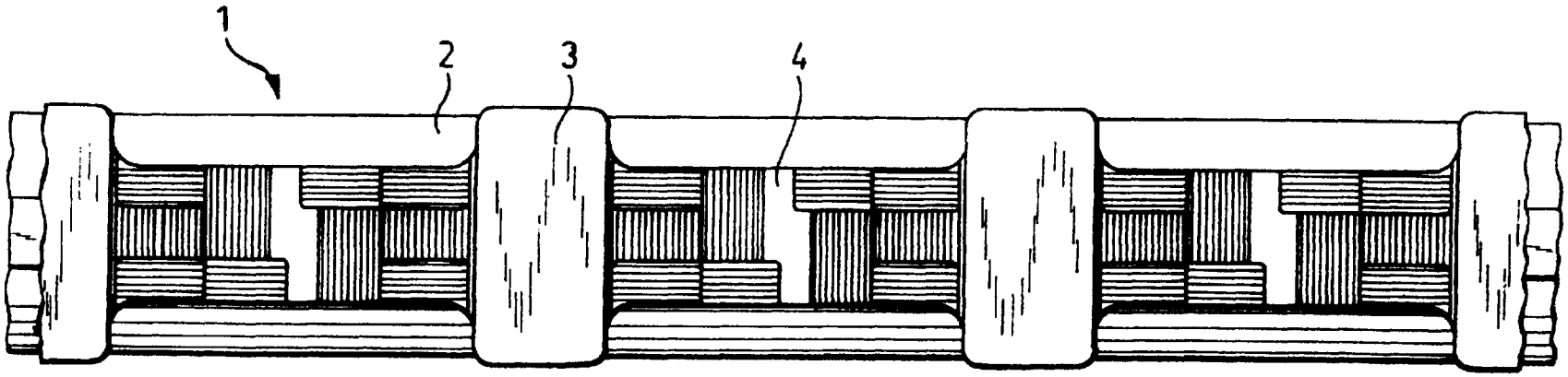
FIG. 1 is a plan view of a walking or a fixed beam of a walking beam furnace.
Figure 2:
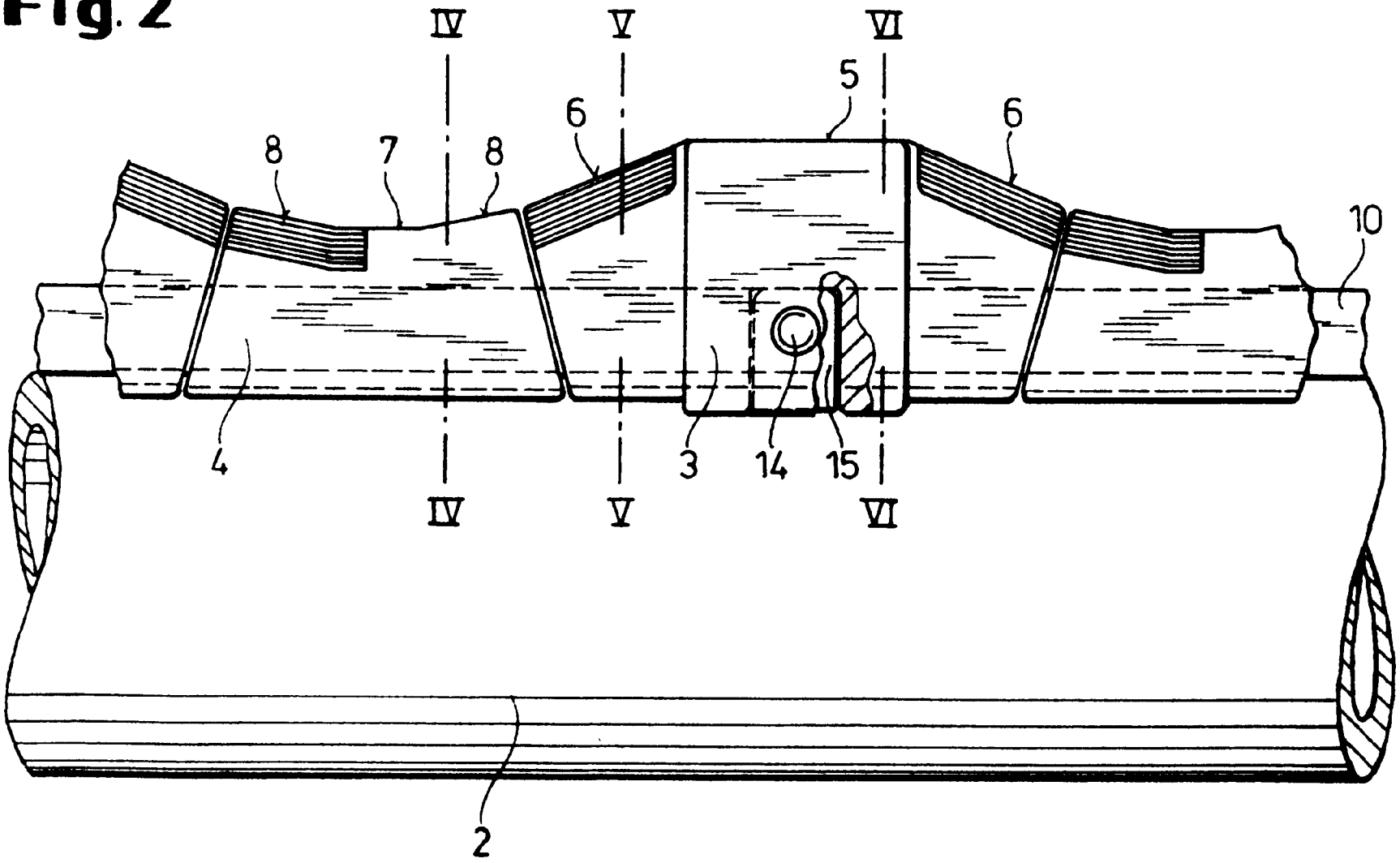
FIG. 2 is a side view of the walking or fixed beam shown in FIG. 1.

Walking beams and fixed beams 1 comprise a cooled bearer pipe 2 provided with flat object support members 3 and rounded object support members 4. The support members 3 and 4 are arranged alternately on the bearer pipe 2.

The flat object support members 3 have a flat supporting face 5 with sloping surfaces 6 both in front of and behind it in the feeding direction. The rounded object support members 4, on the other hand, are distinguished by a narrow horizontal face, situated in the middle when viewed from the side, from which sloping surfaces 8 slope upwards in front and behind, in the feeding direction.

The flat supporting faces 5 serve as supporting surfaces for flat objects to be heated, while the troughs made up of the sloping surfaces 6, 8 and the horizontal surface 7 serve to receive rounded objects to be heated.

The flat object support members 3 have a bore 9 in the middle to receive a pin 13 serving to fasten them to the bearer pipe 2, the bore being closed by a stopper 14 to prevent the pin 13 falling out. The pin 13 connects the flat object support member 3 to a cam member 15 which is welded to a longitudinal rib 10 and likewise has a bore in the middle.

The rounded object support members 4 are merely pushed on to the longitudinal rib 10 of the bearer pipe 2 and retained by form-locking between two flat object support members 3 which at the same time prevent them from being lifted up.

Figure 3:
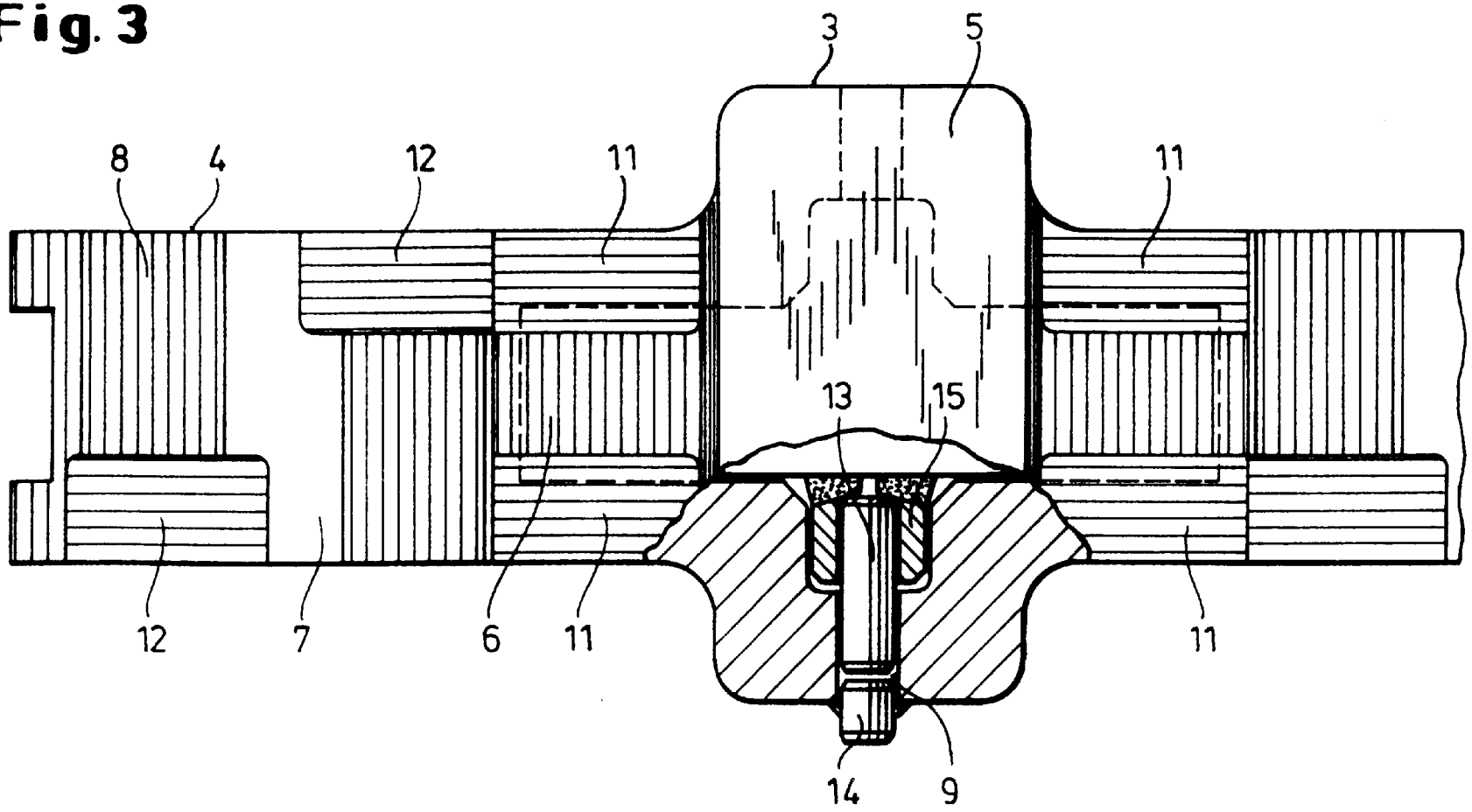
FIG. 3 is a plan view of several carrying members.

FIG. 3 shows that the flat supporting face 5 of the flat object support member 3 is wider when viewed in the feeding direction than its sloping surfaces 6 arid than the round object support member 4. This serves to ensure the necessary supporting surface for the flat objects to be annealed.

The sloping surfaces 6, when viewed in the feeding direction, are each again bevelled on the left and right. The sloping surfaces 8 of the rounded object support members 4 only exhibit such a downward bevel 12 alternately. This arrangement reduces the accumulation of scale on the support members. Furthermore the arrangement of the supporting faces and the alternation of the laterally downwardly-sloping bevelled surfaces brings about a constant change in the positions on the object being annealed at which it is supported and thereby its uniform heating.

Figure 6:
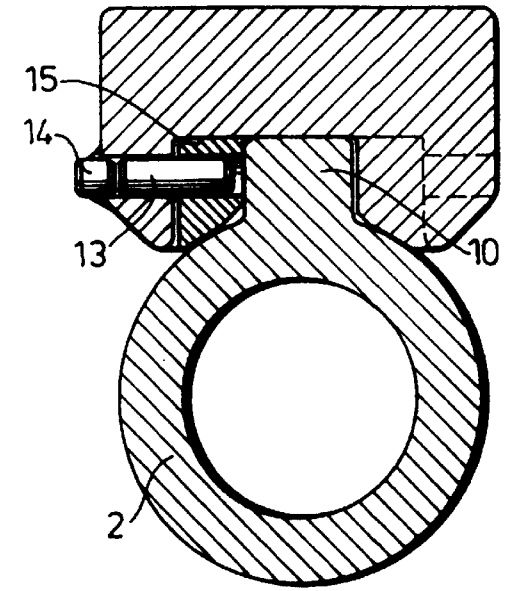
FIG. 6 is a section along the line VI—VI in FIG. 2.
Figure 5:
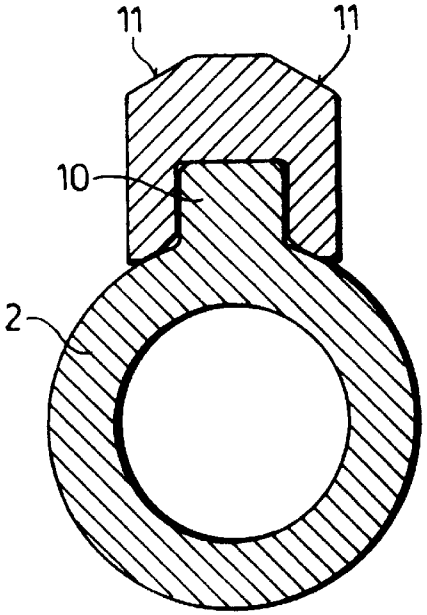
FIG. 5 is a section along the line V—V in FIG. 2.
Figure 4:
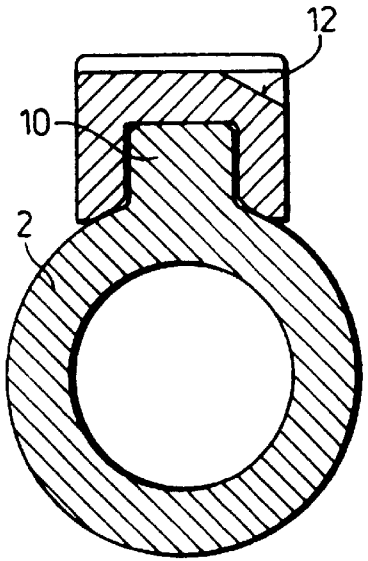
FIG. 4 is a section along the line IV—IV in FIG. 2.

FIGS. 4 to 6 show that the foot of the support members is U-shaped and is thus adapted to the form of the longitudinal rib 10 of the bearer pipe 2.

What is claimed is:

1. Walking beam furnace for heating material to be annealed, which furnace comprises in its interior:

fixed beams (1) for holding a material to be annealed;

walking beams (1) for transporting the material to be annealed; and flat-material support members (3) and round-material support members (4) on upper sides of the fixed and walking beams, for the material to be annealed;

wherein said flat-material support members (3) comprise a flat supporting face (5) with downwardly sloping beveled surfaces (6) in front and behind it.

2. A walking beam furnace according to claim 1, wherein a longitudinal rib (10) is provided on the upper sides of the walking beams and the fixed beams (1) for receiving the support members.

3. A walking beam furnace according to claim 2, wherein the support members (3, 4) comprise a foot adapted to the longitudinal rib (10) and further comprise a supporting face (5, 6, 7, 8).

4. A walking beam furnace according to claim 2, wherein the longitudinal rib (10) is provided with cam members (15).

5. A walking beam furnace according to claim 4, wherein the cam members (15) are welded on to the longitudinal rib on both sides thereof.

6. A walking beam furnace according to claim 4, wherein the cam members (15) are provided with bores (9).

7. A walking beam furnace according to claim 6, wherein the flat-material support members (3) are attached to the cam members (15) by means of bolts (13) inserted into the bores (9) in the flat material support members (3).

8. A walking beam furnace according to claim 7, wherein the bolts (13) are secured against falling out of the bores (9) by stoppers (14) that close up the latter.

9. A walking beam furnace according to claim 1, wherein the flat-material support members (3) comprise a flat supporting face (5) and the round-material support members (4) comprise trough-shaped supports (7, 8), and wherein the support members (3, 4) are arranged upon the fixed and walking beams one after another in an alternating manner.

10. A walking beam furnace according to claim 9, wherein the flat supporting face (5) is wider than the combination of the trough-shaped supports (7, 8) and the downwardly sloping beveled surfaces (6).

11. A walking beam furnace according to claim 9, wherein the trough-shaped supports of the round-material support members (4) comprise a narrow flat portion (7) with upwardly sloping beveled surfaces (8) in front of and behind it in a feeding direction.

12. A walking beam furnace according to claim 11, wherein each upwardly sloping beveled surface (8) includes faces (12), alternately sloping downward left and right in the feeding direction.

13. A walking beam furnace according to claim 1, wherein the flat-material support members (3) are releasably connected to the beams (1).

14. A walking beam furnace according to claim 1, wherein the downwardly sloping beveled surfaces (6) further comprise downwardly sloping surfaces (11) on either side thereof in a feeding direction.

15. A walking beam furnace according to claim 1, wherein the flat-material support members (3) have lateral bores (9) therein.

16. A walking beam furnace according to claim 1, wherein each round-material support member (4) is form-locked between two flat-material support members (3).

* * * * *